US011731168B2

(12) United States Patent
Boerhof et al.

(10) Patent No.: US 11,731,168 B2
(45) Date of Patent: Aug. 22, 2023

(54) AIR SEPARATION SYSTEM

(71) Applicant: Bollegraaf Patents and Brands B.V., Appingedam (NL)

(72) Inventors: Henk Boerhof, Appingedam (NL); Alexander Zwiers, Appingedam (NL)

(73) Assignee: Bollegraaf Patents and Brands B.V., Appingedam (NL)

( * ) Notice: Subject to any disclaimer, the term of this patent is extended or adjusted under 35 U.S.C. 154(b) by 0 days.

(21) Appl. No.: 17/726,571

(22) Filed: Apr. 22, 2022

(65) Prior Publication Data

US 2022/0362808 A1 Nov. 17, 2022

(30) Foreign Application Priority Data

Apr. 28, 2021 (NL) ..... 2028083

(51) Int. Cl.

| | |
|---|---|
| ***B07B 7/04*** | (2006.01) |
| ***B07B 11/04*** | (2006.01) |
| ***B07B 7/02*** | (2006.01) |
| ***B07B 11/06*** | (2006.01) |

(52) U.S. Cl.

CPC ..... *B07B 7/04* (2013.01); *B07B 11/04* (2013.01)

(58) Field of Classification Search

CPC .. B07B 7/04; B07B 11/04; B07B 7/02; B07B 11/06; B07B 4/02; B07B 4/00; B07B 4/08

USPC ..... 209/155

See application file for complete search history.

(56) References Cited

U.S. PATENT DOCUMENTS

| | | | | |
|---|---|---|---|---|
| 2,204,032 | A | 6/1940 | Whitlock | |
| 4,465,194 | A * | 8/1984 | Coleman | B07B 11/04 209/664 |
| 5,409,118 | A * | 4/1995 | Bielagus | D21B 1/023 209/147 |
| 5,607,061 | A | 3/1997 | Felden | |
| 10,131,507 | B1 * | 11/2018 | Doak | B65G 51/02 |
| 2020/0010149 | A1 | 4/2020 | Barnstedt | |
| 2020/0101495 | A1 * | 4/2020 | Barnstedt | B07B 7/02 |

FOREIGN PATENT DOCUMENTS

| | | | |
|---|---|---|---|
| CH | 294201 | A | 10/1953 |
| WO | 2017/120292 | A1 | 7/2017 |

* cited by examiner

*Primary Examiner* — Gene O Crawford
*Assistant Examiner* — Muhammad Awais
(74) *Attorney, Agent, or Firm* — N.V. Nederlandsch Octrooibureau

(57) ABSTRACT

An air separation system for sorting waste items, comprising a main housing having an intake portion for receiving a laminar intake air stream carrying waste items in an intake air direction and an exhaust portion comprising one or more baffle members transversely arranged with respect to the intake air direction for defining a plurality of exhaust channels. A curved guide shell is provided comprising a plurality of interconnected guide plates transversely arranged with respect to the intake air direction. The guide shell comprises a guide surface for guiding the intake air stream. The main housing comprises a plate connecting arrangement on opposing transverse sides of the main housing configured for releasable connection to opposing ends of each of the plurality of guide plates.

15 Claims, 8 Drawing Sheets

AIR SEPARATION SYSTEM

FIELD OF THE INVENTION

The present invention relates to an air separation system, in particular to an air separation system for sorting waste items carried by an air stream.

BACKGROUND ART

U.S. Pat. No. 10,131,507 B1 pertains to a material handling conduit, and particularly to an ejection hood useful for transferring an airborne stream of ejected material from one conveyor to a second conveyor. An ejection hood apparatus is disclosed that includes a transfer conduit and a hood. The transfer conduit includes a downwardly concave control shell. An inlet end portion of the transfer conduit receives an upwardly directed transfer air stream including ejected material with at least a partially upward trajectory. The hood defines an ejection chamber including a lower chamber portion and an upper chamber portion. The lower chamber portion receives the transfer air stream from an outlet end portion of the transfer conduit with at least a partially downward trajectory. The hood includes at least one air outlet passage communicated with the upper chamber portion for exhausting at least a portion of the transfer air stream.

US patent application US 2020/0101495 A discloses a method and a device applying said method for the separation of a primarily heterogeneous material stream, as commonly encountered in the waste management industry. The device primarily constitutes a housing which features a cylindrical component, into which a gas stream is introduced by means of a gas injection nozzle, which passes through the material stream, which contains individual fractions at least once. Due to the specific curvatures of the cylindrical housing part and the specific arrangement of several flow control elements as well as the associated interaction of the undisturbed laminar gas/material stream with the separation of the individual fractions in the interior of the housing, a compact design of the device as well as a high degree of separation can be achieved.

SUMMARY OF THE INVENTION

The present invention seeks to provide an improved air separation system for sorting waste items carried by an air stream, e.g. a laminar air stream, wherein the air separation system provides increased adjustability and modularity on how waste items are sorted whilst maintaining laminar flow through the air separation system.

According to the present invention, an air separation system as defined above is provided, comprising a main housing having an intake portion for receiving a laminar intake air stream carrying waste items in an intake air direction and an exhaust portion comprising one or more baffles members transversely arranged with respect to the intake air direction for defining a plurality of exhaust channels;

a curved guide shell comprising a plurality of interconnected guide plates transversely arranged with respect to the intake air direction, wherein the guide shell comprises an upstream end arranged above the intake portion of the main housing, and wherein the guide shell comprises a guide surface configured for guiding the intake air stream with waste items when the air separation system is in operation; and wherein the main housing comprises a plate connecting arrangement on opposing transverse sides of the main housing configured for releasable connection to opposing ends of each of the plurality of guide plates.

The plate connecting arrangement on opposing transverse sides of the main housing allows for a modular and adjustable guide shell configuration to guide waste items carried in the intake air stream toward one of the exhaust channels as defined by the one or more baffle members. So depending on the type of waste items being supplied to the intake portion of the main housing, the plate connecting arrangement allows the plurality of interconnected guide plates to be arranged differently for changing the guide surface in a way that suits the type of waste items and sorting requirements thereof.

In an advantageous embodiment, the plate connecting arrangement comprises a predetermined pattern of a plurality of spaced apart plate attachment points on both of the opposing transverse sides of the main housing. This allows adjustable (re)arrangement of one or more guide plates by moving opposing ends thereof to different plate attachment points of the predetermined pattern. In an exemplary embodiment, the plurality of spaced apart plate attachment points comprises a plurality of spaced apart through holes in the main housing, allowing the opposing ends of each of the plurality of guide plates to be bolted to the main housing for example.

Modularity of the air separation system is further facilitated in an embodiment wherein one or more guide plates of the plurality of guide plates are substantially flat rectangular guide plates. In this embodiment the rectangular flat guide plates can be interconnected to one another at angles between 135° and 180° degrees to create the curved guide shell and guide surface thereof. In this way a different guide shell can be achieved with the same rectangular guide plates.

In an advantageous embodiment, one or more guide plates of the plurality of guide plates comprise a plurality of elongated plate slots extending in the intake air direction and wherein the plurality of elongated plate slots are spaced in apart in parallel fashion, i.e. spaced apart transversely/laterally with respect to the intake air direction. As the intake air stream passes along the guide surface when the air separation system is in operation, the plurality of elongated plate slots allows some air to pass through so as to provide a gradual pressure gradient across the one or more guide plates and as such maintain the laminar intake air stream along the guide surface.

A laminar intake air stream may be further maintained in an advantageous embodiment wherein the main housing comprises a plurality of elongated housing slots extending in the intake air direction D and being spaced in apart in parallel fashion, i.e. spaced apart transversely/laterally with respect to the intake air direction.

SHORT DESCRIPTION OF DRAWINGS

The present invention will be discussed in more detail below, with reference to the attached drawings, in which FIG. 1 shows an air separation system connected to a waste conveyor system according to an embodiment of the present invention;

FIG. 9 shows a front view of a safety door arrangement in an unlocked state according to an embodiment of the present invention; and wherein

DESCRIPTION OF EMBODIMENTS

Figure 1:
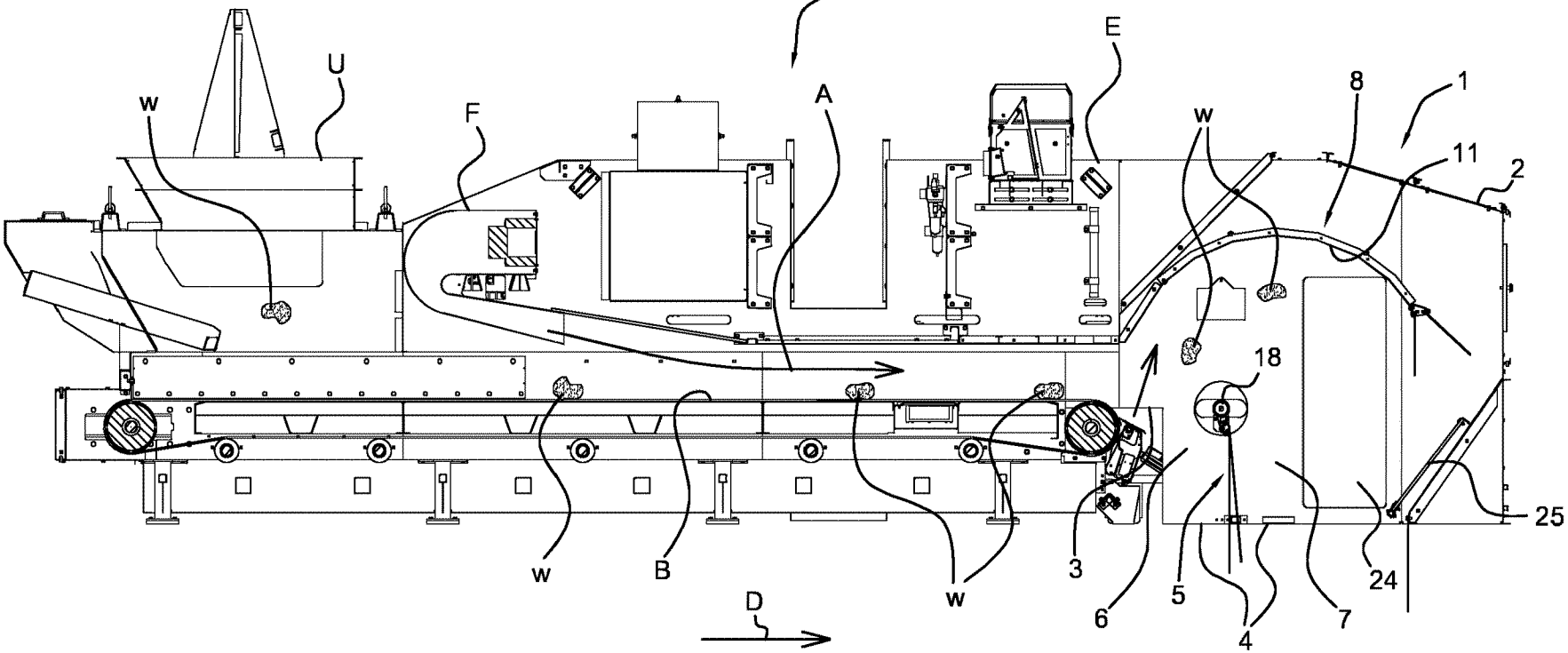
Figure 2:
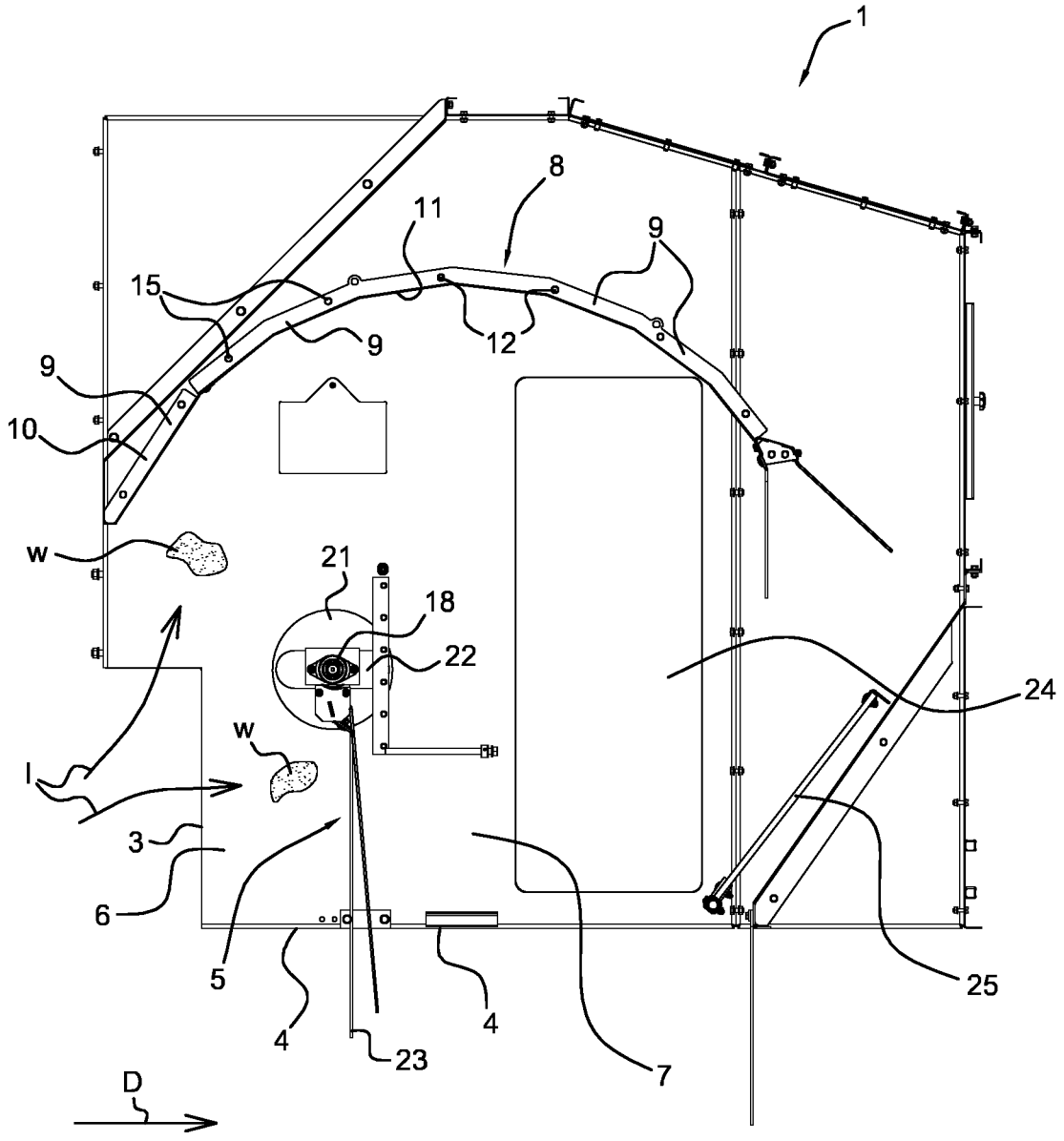
FIG. 2 shows a side view of a first flow control plate arrangement according to an embodiment of the present invention.
Figure 5:
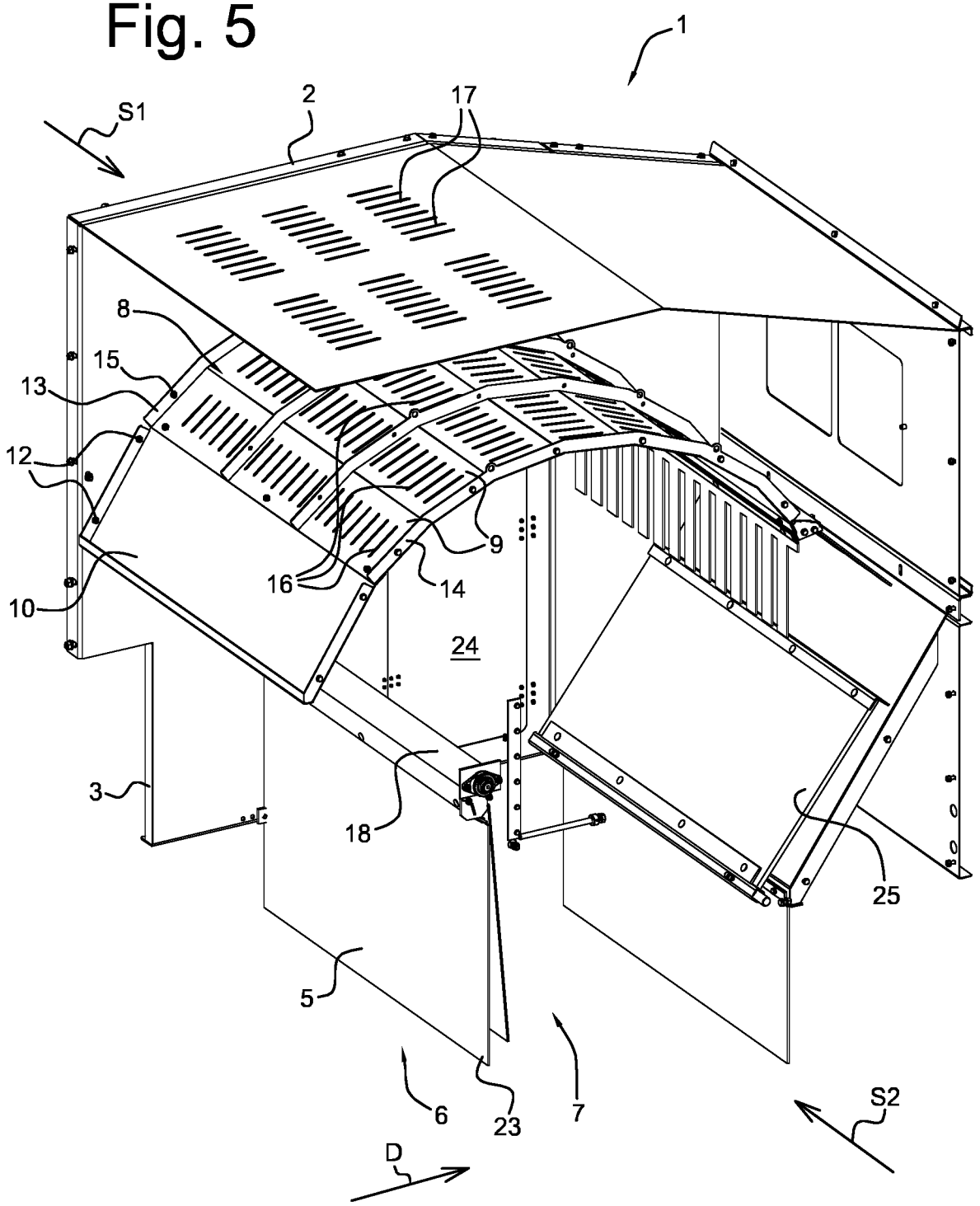
FIG. 5 shows a three dimensional view of slotted flow control plates according to an embodiment of the present invention.

With reference to FIGS. 1, 2 and 5, an air separation system 1 for sorting waste items W is disclosed. As shown, in an exemplary industrial application the air separation system 1 may be used in conjunction with waste conveyor system C of which a downstream end E is connected to the air separation system 1. The waste conveyor system C may provide waste items W by means of a conveyor belt B toward the downstream E, wherein the waste conveyor system C may further comprise an upstream end U arranged to receive the waste items W.

In an advantageous embodiment, the waste conveyor system C comprises a laminar flow unit F which is configured to provide a laminar stream of air A over conveyor belt B and with a speed matching a speed of the conveyor belt B, thereby allowing lightweight waste items W to remains substantially stationary with respect to the conveyor belt B when moving toward the downstream end E.

The air separation system 1 comprises a main housing 2 for receiving a laminar intake air stream I carrying waste items W in an intake air direction D and an exhaust portion 4 comprising one or more baffle members 5 transversely arranged with respect to the intake air direction D for defining a plurality of exhaust channels 6, 7.

A curved guide shell 8 is provided and comprises a plurality of interconnected guide plates 9 transversely arranged with respect to the intake air direction D, wherein the guide shell 8 comprises an upstream end 10 arranged above the intake portion 3 of the main housing 2. The guide shell 9 comprises a guide surface 11 configured for guiding the intake air stream I with waste items W when the air separation system 1 is in operation. Note that the guide surface 11 is formed by individual surfaces of the plurality of interconnected guide plates 9, i.e. formed by individual guide surfaces of each guide plate (9) collectively.

Referring to FIG. 5, the main housing 2 comprises a plate connecting arrangement 12 on opposing transverse sides S1, S2 of the main housing 2 and configured for releasable connection to opposing ends 13, 14 of each of the plurality of guide plates 9. Here, the opposing transverse sides S1, S2 may be seen as opposing walls in transverse/lateral direction with respect to the intake air direction D. Note that the indicated transverse side S2 of the opposing transverse sides S1, S2 is not shown in FIG. 5 to allow an interior view of the air separation system 1.

The plate connecting arrangement 12 on the opposing transverse sides S1, S2 of the main housing 2 allows for a modular and adjustable curved guide shell 8 to guide waste items W carried in the intake air stream I toward one of the exhaust channels 6, 7 as defined by the one or more baffle members 5. So, depending on the type of waste items W being supplied to the intake portion 3 of the main housing 2, the plate connecting arrangement 12 allows the plurality of interconnected guide plates 9 to be arranged differently in the housing 2 for changing the guide surface 11 in a way that suits the type of waste items W and sorting requirements thereof. Furthermore, the plate connecting arrangement 12 allows the guide shell 8 to be arranged and shaped for optimally maintaining laminar flow in the main housing 2.

Figure 3:
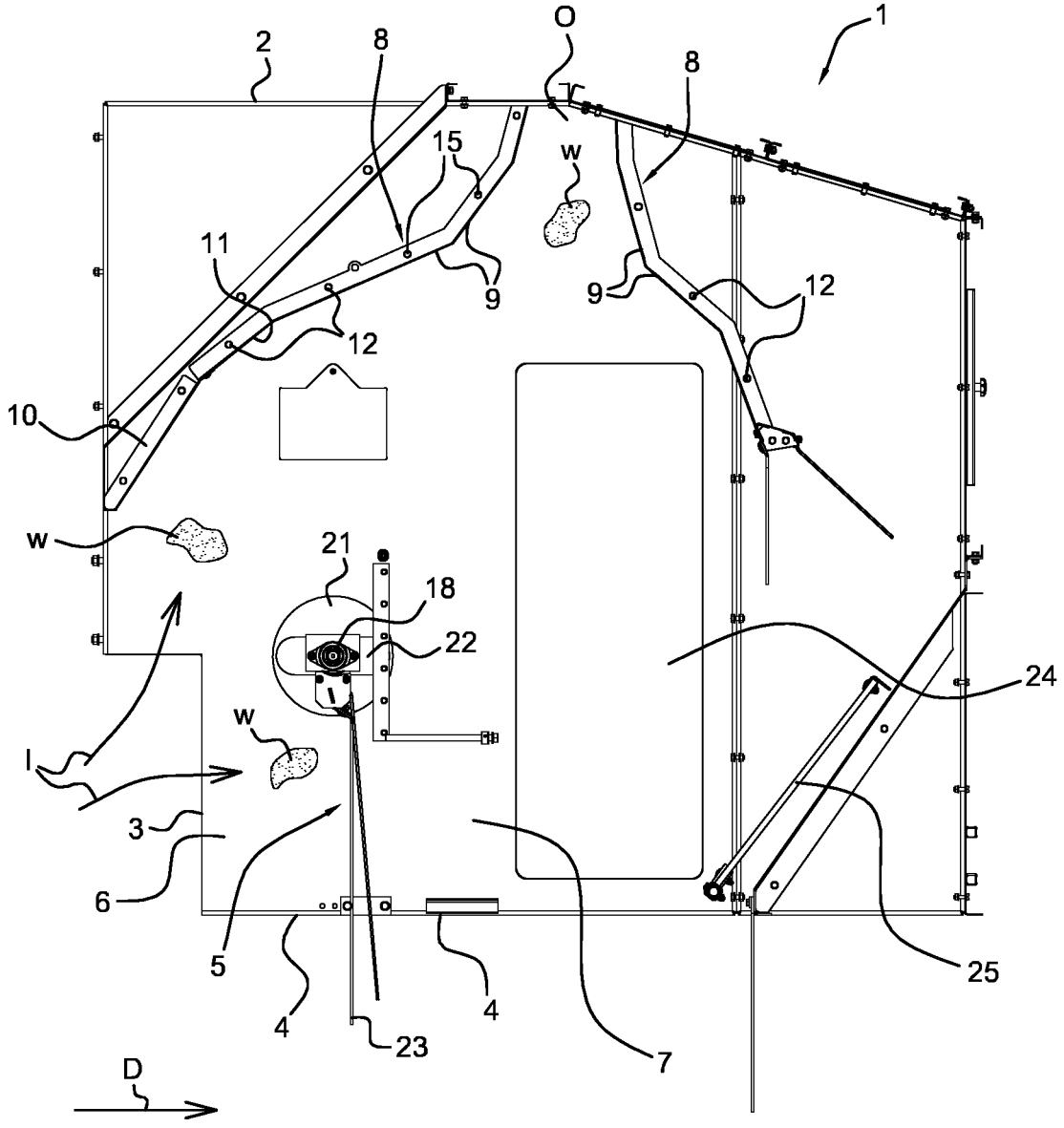
FIG. 3 shows a side view of a second flow control plate arrangement according to an embodiment of the present invention.
Figure 4:
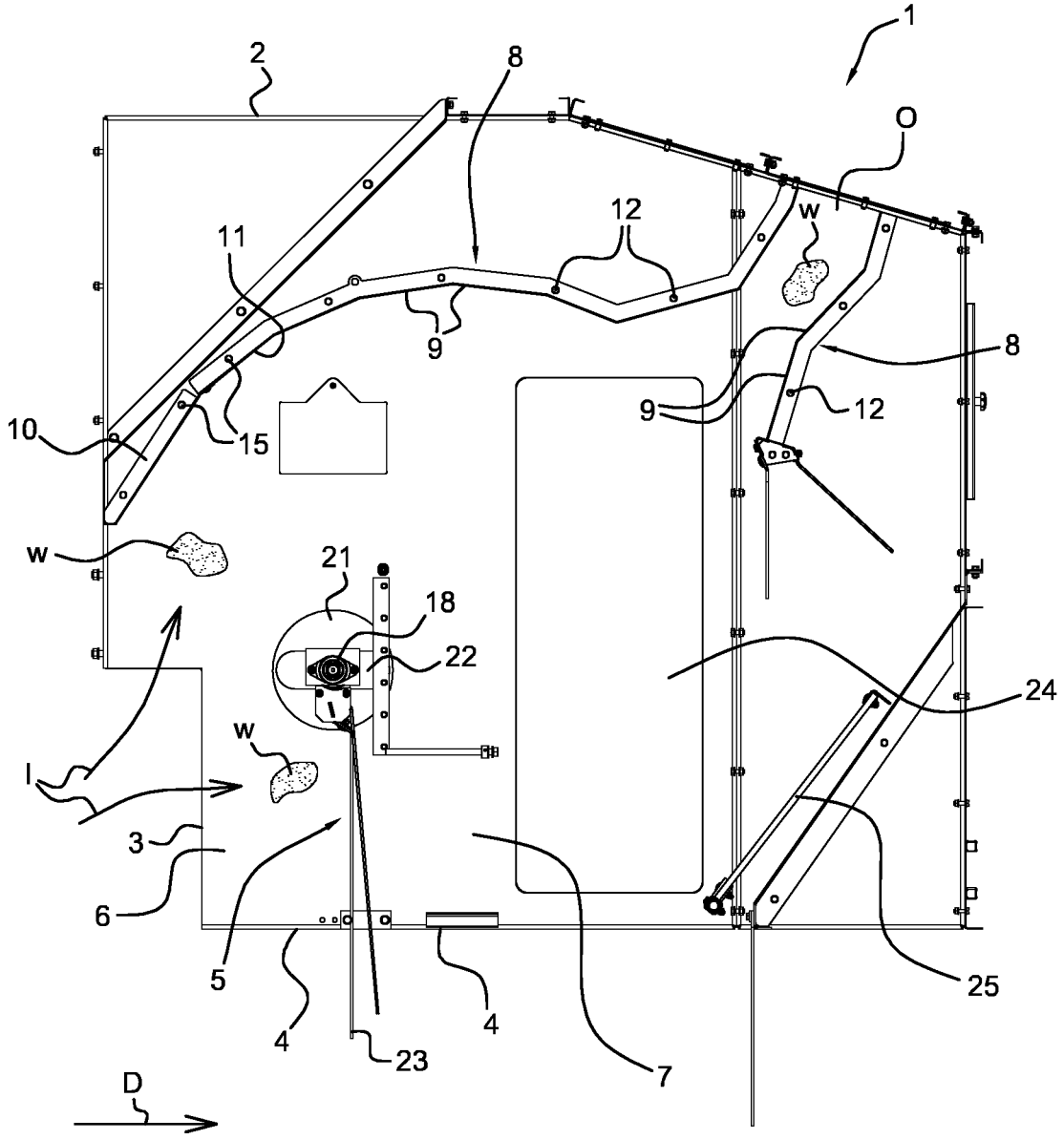
FIG. 4 shows a side view of a third flow control plate arrangement according to an embodiment of the present invention.

Example embodiments of curved guide shells 8 are depicted in FIGS. 2, 3, and 4. For example, FIG. 2 shows a guide shell 8 formed as concave guide shell 8 as seen from below. Waste items Win the intake air stream I will be guided there along and drop at some point through one of the exhaust channels 6, 7 depending on their weight, shape etc.

Referring to FIGS. 2 and 3, in some applications it may be advantageous to utilize a suction arrangement for the air separation system 1 to allow extraction of very light plastic foils for example. The plate connecting arrangement 12 on the opposing transverse sides S1, S2 then allows the opposing ends 13, 14 of each of the plurality of guide plates 9 to be connected to the main housing 2 for obtaining a funnel like guide shell 8 converging to a suction opinion O of the main housing 2, e.g. in a top side of the main housing 2. The suction opening O may be connected to the aforementioned suction arrangement, which is not shown.

As depicted in FIGS. 3 and 4, the suction opening O may be arranged closer or further away from the intake portion 3 depending on various sorting requirements, such as the material and shape of the waste items W.

In an embodiment, the plate connecting arrangement 12 may comprise a predetermined pattern of a plurality of spaced apart plate attachment points 15 on both of the opposing transverse sides S1, S2 of the main housing 2. This allows for convenient arrangement of the plurality of guide plates 9 when a particular curvature of the guide shell 8 is required. As depicted in FIG. 2 for example, the plate attachment points 15 may follow a concave curvature along each of the transverse sides S1, S2. In FIGS. 3 and 4, for example, the plate attachment points 15 may follow an S-shape curvature along each of the transverse sides S1, S2 for achieving a funnel like guide shell 8.

In a specific embodiment, the plurality of spaced apart plate attachment points 15 may comprise a plurality of spaced apart through holes in the main housing 2. This allows the opposing ends 13, 14 of the plurality of guide plates 9 to be conveniently bolted to the transverse sides S1, S2, for example.

It is worth noting that in an embodiment the predetermined pattern of the plurality of spaced apart plate attachment points 15 may be a regular pattern (not shown). That is, it is conceivable that the opposing transverse sides S1, S2 are each provided with a regular pattern of plate attachment points 15, such as a regular array of plate attachment points 15 to further facilitate modularity of different arrangements possible for the plurality of interconnected guide plates 9.

Referring to FIG. 5, in an embodiment the one or more guide plates of the plurality of guide plates 9 are substantially flat rectangular guide plates. In this embodiment, the rectangular guide plates 9 may be seen as elongated plate strips that can be interconnected to one another along their longest sides at angles between e.g. 135° and 180° degrees to create a curved guide shell 8, i.e. a curved guide surface 11. As depicted, the opposing ends 13, 14 of such rectangular guide plates 9 are comprised by shortest opposing sides of the rectangular guide plates 9. This embodiment increases configuration modularity and flexibility of the guide shell 8 as guide plates 9 in the form of elongated plate strips allow for various guide surfaces 11 with different curvatures depending on the angles between interconnected guide plates 9.

As mentioned earlier, the air separation system 1 for sorting waste items W provides adjustability on how waste items W are sorted whilst maintaining laminar flow through the air separation system 1. To further ensure that the intake air stream I remains laminar, various embodiments are provided. For example, in an embodiment one or more guide plates of the plurality of guide plates 9 comprise a plurality of elongated plate slots 16 extending in the air intake air direction D and being spaced in apart in parallel fashion, i.e. spaced apart transversely/laterally with respect to the intake air direction D. The elongated guide slots 16 form a pattern of spaced apart parallel slots between the opposing ends 13, 14. In this embodiment, the intake air stream I is able to flow along the guide surface 11 when the air separation system 1 is in operation, but wherein the plurality of elongated plate slots 16 allows some air to pass through for providing a gradual pressure gradient across the one or more guide plates 9 and a such preserve a laminar intake air stream I along the guide surface 11 as much as possible.

A laminar intake air stream I may be further maintained in an advantageous embodiment wherein the main housing 2 comprises a plurality of elongated housing slots 17 extending in the intake air direction D and being spaced in apart in parallel fashion, i.e. spaced apart transversely/laterally with respect to the intake air direction D. By providing both the guide shell 8 and the main housing 2 with the elongated plate slots 16 and housing slots 17, respectively, provides for an even more gradual pressure gradient across the guide shell 8 to maintain laminar flow. It is worth noting that elongated housing slots 17 may not be used when a suction opening O in the main housing 2 is utilized in conjunction with a suction arrangement as mentioned earlier in light of FIGS. 3 and 4.

From the above it is clear that the plate connecting arrangement 12 of the air separation system 1 allows for modular and flexible guide shell 8 configurations so as to maintain laminar flow as much as possible when waste items W are carried by a laminar intake air stream I which is guided at least in part along the guide surface 11 when the air separation system 1 is in operation.

Figure 6:
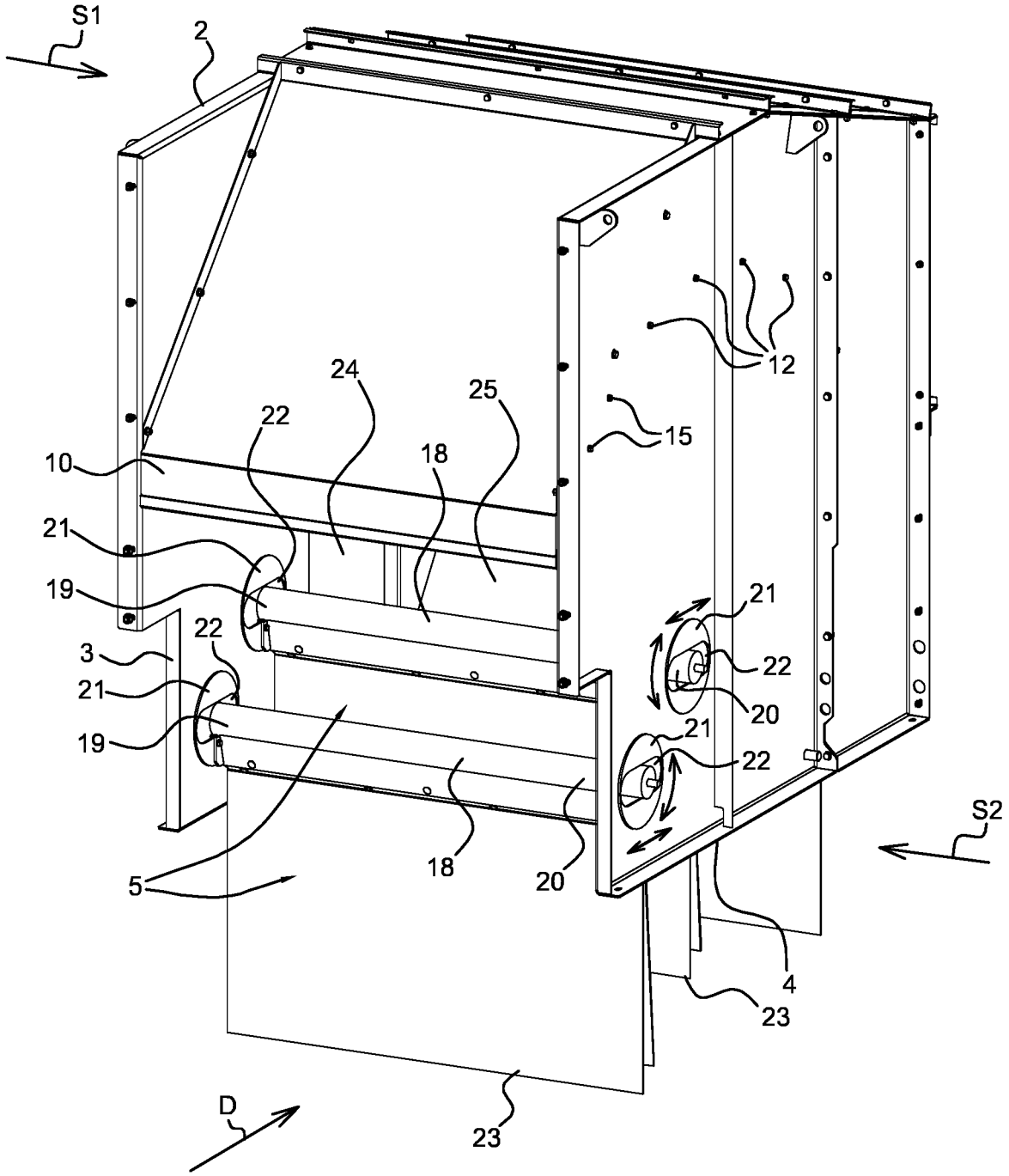
FIG. 6 shows a three dimensional view of flow control rollers according to an embodiment of the present invention.

Referring to FIGS. 5 and 6, at some point in the main housing 2 during operation the waste items W drop toward an exhaust channel of the plurality of exhaust channels 6, 7. To facilitate that waste items W drop into an exhaust channel there is provided an embodiment wherein each baffle member 5 comprises a rotatable roller part 18 arranged along a top side of the baffle member 5, and wherein the roller part 18 comprises two opposing ends 19, 20 each of which is moveably mounted to the main housing 2. This embodiment allows each baffle member 5 to be moved to a desired position in the main housing 2 so as to take into account trajectories of waste item W and to set an appropriate dividing line accordingly Also, each roller part 18 may prevent waste items W to remain stuck on a baffle member 5.

As further shown in FIG. 6, an advantageous embodiment is provided wherein each end 19, 20 of the roller part 18 is linearly movable in a rotatable mounting plate 21 of the main housing 2. In this embodiment the opposing transverse sides S1, S2 of the main housing 2 comprise opposing mounting plates 21 between which a roller part 18 is arranged and wherein each end 19, 20 of the roller part 18 is linearly movable in a corresponding mounting plate 21 of a corresponding transverse side S1, S2. Allowing each end 19, 20 of the roller part 18 to be linearly movable may be achieved in an exemplary embodiment wherein the mounting plates 21 between which the roller part 18 is mounted each comprise straight slots 22 for holding an end 19, 20 of the roller part 18. By rotating both opposing mounting plates 21 and linearly moving the roller part 21 through the slots 22 allows all positions in a plane parallel to the transverse sides S1, S2 to be achieved. As will be understood, an outer diameter of each of the opposing mounting plates 21 and the length of a straight slot 22 extending there through determines a maximum displacement possible for the opposing ends 19, 20 of the roller part 18.

In an embodiment, the roller part 18 of a baffle member 5 may be configured to rotate for moving waste items W, e.g. in the intake air direction D. This embodiment allows a roller part 18 to rotate such that waste items W are pushed from the roller part 18 toward a desired exhaust channel 6, 7. Note that such rotation of the roller part 18 may further preserve laminar flow in the main housing 2.

In an advantageous embodiment, the roller part 18 may comprises an internally arranged electric motor, thereby allowing for a compact design for rotation of the roller part 18.

The behaviour of waste items W engaging the roller part 18 may be influenced by considering an embodiment wherein the roller part 18 comprises a circular, oval, rectangular or square outer perimeter. So in this embodiment it is considered that for particular waste items W it may be beneficial to utilize a circular, oval or square roller part 18 to achieve proper separation by the air separation system 1.

In an embodiment, each baffle member 5 may comprises an adjustable screen 23 arranged underneath and extending along the roller part 18, allowing further adjustments to be made to the plurality of exhaust channels 6, 7 and to preserve laminar air flow through the main housing 2 as much as possible. In an exemplary embodiment, the adjustable screen 23 may be rotationally arranged underneath/along the roller part 18, so that the angle, shape, tapering etc. of the plurality of exhaust channels 6,7, can be adapted to maintain proper separation of waste item W as well as laminar flow.

Referring to FIGS. 7 to 10, but also see FIGS. 1 to 6, in an embodiment the main housing 2 may comprise an access door 24 for allowing internal access to the main housing 2 for e.g. maintenance and servicing purposes. A rotatable platform 25 is internally arranged in the main housing 2 adjacent to the access door 24, wherein a lever arrangement 26 is provided for rotating the platform 25 between a raised position and a lowered position.

Figure 7:
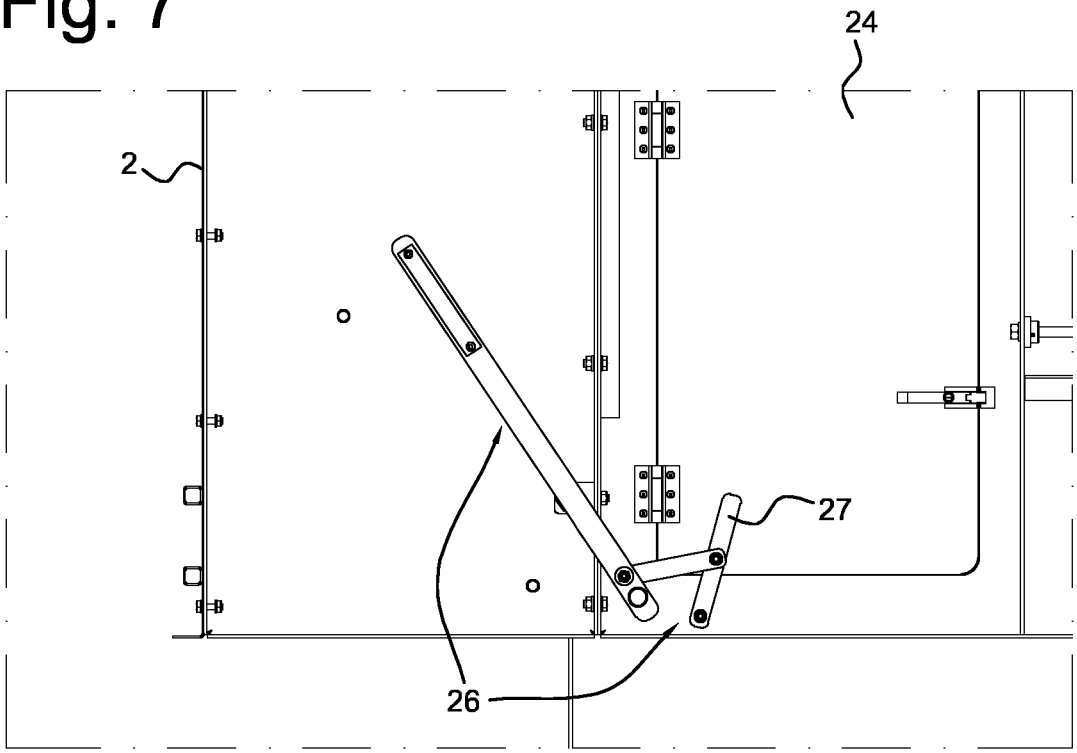
FIG. 7 shows a front view of a safety door arrangement in a locked state according to an embodiment of the present invention.
Figure 8:
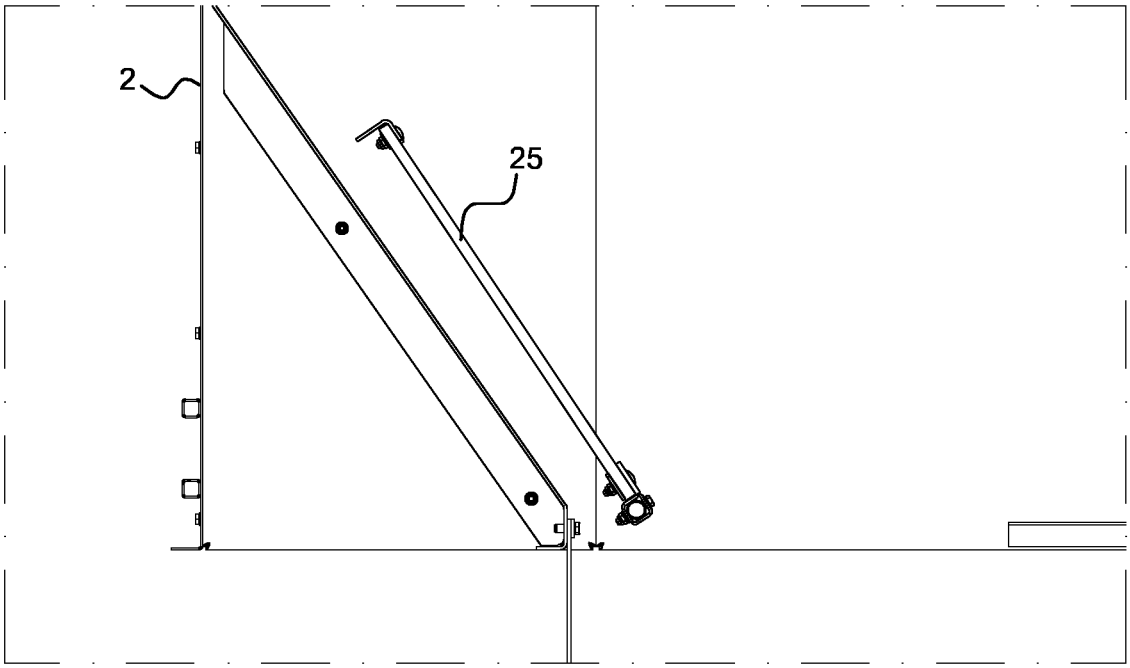
FIG. 8 shows a front view of a servicing platform in an raised position according to an embodiment of the present invention.
Figure 9:
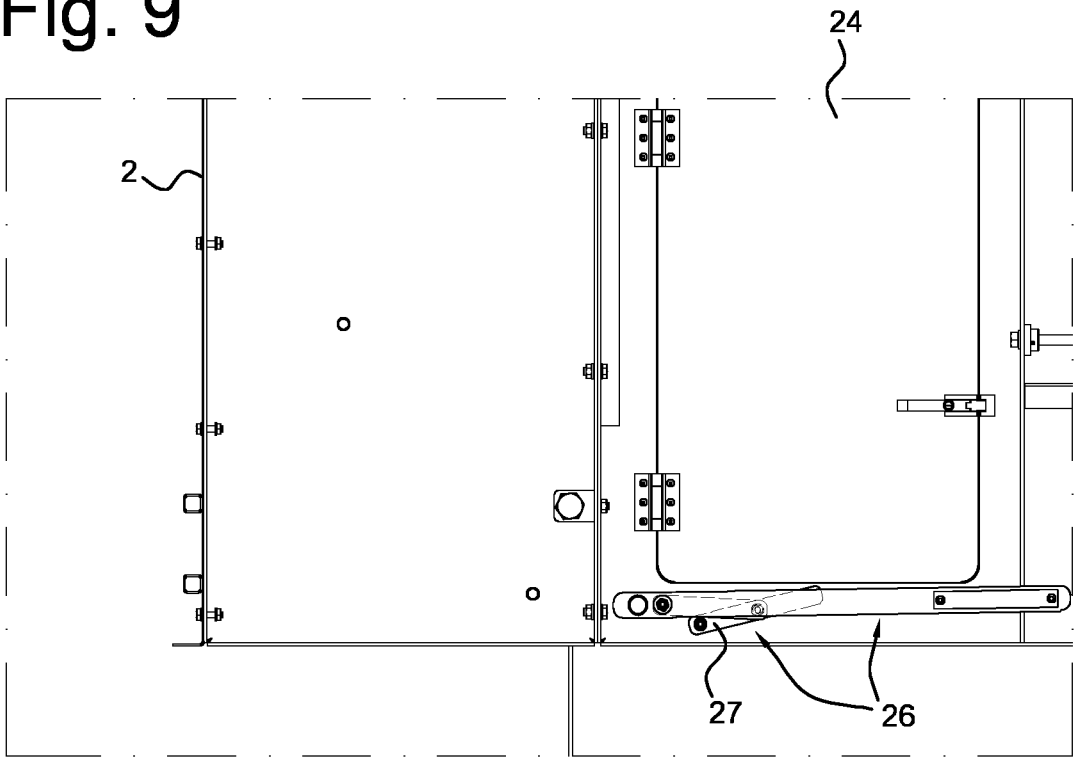
Figure 10:
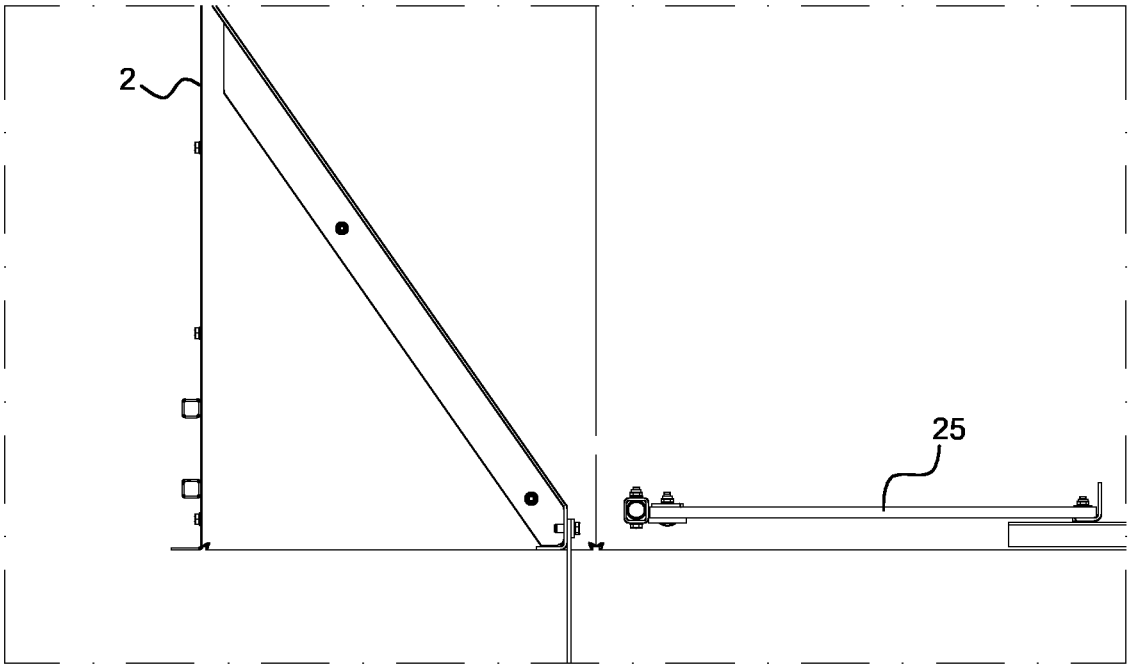
FIG. 10 shows a front view of a servicing platform in a lowered position according to an embodiment of the present invention.

To be clear, FIGS. 7 and 8 show the lever arrangement 26 for the raised position of the platform 25 and where FIGS. 9 and 10 show the lever arrangement 26 for the lowered position of the platform 25. In an exemplary embodiment, the lever arrangement 26 is placed outside of the main housing 2. Note that FIGS. 1 to 5 depict the platform 25 in the raised position and where the lever arrangement 26 is not visible as it is on the other, non-visible side of the access door 24.

The lever arrangement 26 may be viewed as an arrangement of hinged linkages allowing convenient lowering of the platform 25 from outside of the main housing 2. Once lowered, a steady and sturdy platform 25 allows access to, for example, the one or more baffle members 5 for servicing or cleaning without falling into one of the exhaust channels 6, 7.

In an advantageous embodiment, see FIGS. 7 and 9, the lever arrangement 26 may comprise a lever member 27 configured to lock the access door when the platform 25 is in the raised position and to unlock the access door 24 when the platform 25 is in the lowered position. As clearly shown in FIGS. 7 and 8, when the platform 25 is in the raised position, the lever member 27 blocks and prevents the access door 24 from opening. In the raised position of the platform 25, the lever arrangement 26 can be said to be in the locked position. This ensures that access to the main housing 2 is denied. As indicated in FIGS. 9 and 10, access to the main housing 2 can only granted when the platform 25 is in the lowered position in which the lever member 27 is moved/rotated away from the access door 24. In the lowered position of the platform 25, the lever arrangement 26 can be said to be in the unlocked position. Therefore, this embodiment ensures that when the access door 24 can be opened, that the platform 25 is in the lowered position to allow for a safe working environment in the main housing 2.

As mentioned earlier in light of FIG. 1, in exemplary industrial applications the air separation system 1 of the present invention may be used in conjunction with a waste conveyor system C of which a downstream end E is connected to the air separation system 1, i.e. the intake portion 3 thereof. The waste conveyor system C may provide waste items W by means of a conveyor belt B toward the intake portion 3. The waste conveyor system C is advantageously configured to provide a substantially laminar intake air stream I carrying waste items W to the air separation system 1.

Therefore, according to a further aspect of the present invention, a combination of the air separation system 1 as disclosed above may be provided and a waste conveyor system C of which a downstream end E is arranged at the intake portion 3 of the main housing 2, wherein the waste conveyor system C comprises a laminar flow unit F arranged at an upstream end U of the waste conveyor system C and wherein the laminar flow unit F is configured to provide a laminar stream of air A over waste items W being transported by the waste conveyer system C toward the air separation system 1, i.e. to the intake portion 3 of the main housing 2. By combining the air separation system 1 of the present invention with the waste conveyor system C allows for an efficient and accurate separation process in which laminar air flow is maximized for stable and predictable trajectories of waste items Win the main housing 2.

The present invention has been described above with reference to a number of exemplary embodiments as shown in the drawings. Modifications and alternative implementations of some parts or elements are possible, and are included in the scope of protection as defined in the appended claims.

The invention claimed is:

1. An air separation system for sorting waste items, comprising a main housing having an intake portion for receiving a laminar intake air stream carrying waste items (W) in an intake air direction (D) and an exhaust portion comprising one or more baffle members transversely arranged with respect to the intake air direction (D) for defining a plurality of exhaust channels;

a curved guide shell comprising a plurality of interconnected guide plates transversely arranged with respect to the intake air direction (D), wherein the guide shell comprises an upstream end arranged above the intake portion of the main housing, and wherein the guide shell comprises a guide surface configured for guiding the intake air stream with waste items (W) when the air separation system is in operation; and wherein the main housing comprises a plate connecting arrangement on opposing transverse sides (S1, S2) of the main housing and configured for releasable connection to opposing ends of each of the plurality of guide plates.

2. The air separation system according to claim 1, wherein the plate connecting arrangement comprises a predetermined pattern of a plurality of spaced apart plate attachment points on both of the opposing transverse sides (S1, S2) of the main housing.

3. The air separation system according to claim 2, wherein the plurality of spaced apart plate attachment points comprises a plurality of spaced apart through holes in the main housing.

4. The air separation system according to claim 1, wherein one or more guide plates of the plurality of guide plates are substantially flat rectangular guide plates.

5. The air separation system according to claim 1, wherein one or more guide plates of the plurality of guide plates comprise a plurality of elongated plate slots extending in the intake air direction (D) and being spaced apart in parallel fashion.

6. The air separation system according to claim 1, wherein the main housing comprises a plurality of elongated housing slots extending in the intake air direction (D) and being spaced apart in parallel fashion.

7. The air separation system according to claim 1, wherein each baffle member comprises a rotatable roller part arranged along a top side of the baffle member, and wherein the roller part comprises two opposing ends each of which is moveably mounted to the main housing.

8. The air separation system according to claim 7, wherein each end of the roller part is linearly movable in a rotatable mounting plate of the main housing.

9. The air separation system according to claim 7, wherein the roller part is configured to rotate for moving waste items (W).

10. The air separation system according to claim 7, wherein the roller part comprises a circular, oval, rectangular or square outer perimeter.

11. The air separation system according to claim 7, wherein the roller part comprises an internally arranged electric motor.

12. The air separation system according to claim 7, wherein each baffle member comprises an adjustable screen arranged underneath and extending along the roller part.

13. The air separation system according to claim 1, wherein the main housing comprises an access door for allowing internal access to the main housing, a rotatable platform internally arranged in the main housing adjacent to the access door, and a lever arrangement for rotating the platform between a raised position and a lowered position.

14. The air separation system according to claim 13, wherein the lever arrangement comprises a lever member configured to block the access door when the platform is in the raised position and to unblock the access door when the platform is in the lowered position.

15. A combination of the air separation system according to claim 1 and a waste conveyor system (C) of which a downstream end (E) is arranged at the intake portion of the main housing, wherein the waste conveyor system (C) comprises a laminar flow unit (F) arranged at an upstream end (U)

of the waste conveyor system (C) and wherein the laminar flow unit (F) is configured to provide a laminar stream of air (A) over waste items (W) being transported by the waste conveyer system (C) toward the air separation system.

* * * * *